US007719514B2

(12) United States Patent
Matsuura

(10) Patent No.: US 7,719,514 B2
(45) Date of Patent: May 18, 2010

(54) APPARATUS AND METHOD FOR CONVERTING A DIGITAL VIDEO SIGNAL TO CONFORM WITH A DISPLAY PANEL FORMAT

(75) Inventor: Minoru Matsuura, Kanagawa (JP)

(73) Assignee: Sony Corporation, Tokyo (JP)

( * ) Notice: Subject to any disclaimer, the term of this patent is extended or adjusted under 35 U.S.C. 154(b) by 751 days.

(21) Appl. No.: 10/568,860

(22) PCT Filed: Aug. 26, 2004

(86) PCT No.: PCT/JP2004/012255

§ 371 (c)(1),
(2), (4) Date: Feb. 21, 2006

(87) PCT Pub. No.: WO2005/022503

PCT Pub. Date: Mar. 10, 2005

(65) Prior Publication Data

US 2006/0262064 A1 Nov. 23, 2006

(30) Foreign Application Priority Data

Aug. 29, 2003 (JP) ..... 2003-307921

(51) Int. Cl.
*G09G 3/36* (2006.01)
*G09G 3/18* (2006.01)
*G09G 5/02* (2006.01)

(52) U.S. Cl. ..... 345/103; 345/51; 345/699

(58) Field of Classification Search ..... 345/51, 345/98–103, 204–206, 694, 93, 698, 603, 345/699; 348/441–459, 555–558
See application file for complete search history.

(56) References Cited

U.S. PATENT DOCUMENTS 5,170,158 A 12/1992 Shinya (Continued)

FOREIGN PATENT DOCUMENTS

JP 62-147488 7/1987

(Continued)

OTHER PUBLICATIONS

Japanese Office Action issued on Nov. 27, 2007.

(Continued)

*Primary Examiner*—Bipin Shalwala
*Assistant Examiner*—Keith Crawley
(74) *Attorney, Agent, or Firm*—Sonnenschein Nath & Rosenthal LLP

(57) ABSTRACT

The present invention is directed to a drive apparatus adapted for driving display panel of the active matrix type, which comprises first signal processing means (3), (5), (7) for converting a digital video signal of m (m is natural number) bits which has been converted into data arrangement in conformity with the display format by data arrangement converting means (2) into parallel analog video signals of p (p is natural number)-phase, second signal processing means (4), (6), (8) for developing the analog video signals of p-phase into analog video signals of x/k (k is natural number)-phase to deliver the analog video signals thus developed to the video signal supply lines, and signal line selecting means (14) for sequentially selecting, one by one, at the same timing, desired signal lines from respective groups of the x/k number of signal lines obtained by dividing x number of signal lines to perform sampling of analog video signals delivered via the x/k number of video signal supply lines with respect to the selected signal lines.

3 Claims, 9 Drawing Sheets

U.S. PATENT DOCUMENTS

| | | | | |
|---|---|---|---|---|
| 6,023,260 | A | 2/2000 | Higashi | |
| 2001/0022581 | A1* | 9/2001 | Koyama et al. | 345/204 |
| 2003/0025666 | A1 | 2/2003 | Ishii | |
| 2003/0085865 | A1 | 5/2003 | Lee | |
| 2003/0193465 | A1* | 10/2003 | Ohkawa et al. | 345/100 |

FOREIGN PATENT DOCUMENTS

| | | |
|---|---|---|
| JP | 03-121415 | 5/1991 |
| JP | 10-149139 | 6/1998 |
| JP | 10-177371 | 6/1998 |
| JP | 11-003068 | 1/1999 |
| JP | 2002-99251 | 4/2002 |
| JP | 2002-108299 | 4/2002 |
| JP | 3446209 | 7/2003 |

OTHER PUBLICATIONS

European Search Report dated Nov. 5, 2007.

* cited by examiner

| NO. OF SELECTED SIGNAL LINES | B/A (TIMES) |
|---|---|
| 1 | 16 |
| 2 | 8 |
| 4 | 4 |
| 6 | 3 |
| 8 | 2 |

A : WRITE TIME BY CONVENTIONAL SYSTEM
B : WRITE TIME BY SIGNAL LINE SELECTION SYSTEM

FIG.6

| RESOLUTION(H×V) | | NO. OF SWITCHES (SIX SIGNAL LINES ARE SELECTED) (N) | NO. OF HORIZONTAL PIXELS (Ha) (Ha) | NO. OF DUMMY PIXELS (D) |
|---|---|---|---|---|
| SVGA | 800×600 | 134 | 804 | 4 |
| XGA | 1024×768 | 171 | 1026 | 2 |
| WXGA | 1386×788 | 231 | *1386 | 0 |
| SXGA | 1280×1024 | 214 | 1284 | 4 |
| SXGA+ | 1400×1050 | 234 | 1404 | 4 |
| UXGA | 1600×1200 | 267 | 1602 | 2 |
| Full HD | 1920×1080 | 320 | *1920 | 0 |

* INDICATES THAT NO DUMMY PIXEL IS REQUIRED

FIG.7

| RESOLUTION (H×V) | | NO. OF OUTPUTS <SIX SIGNAL LINES ARE SELECTED> (N) | TOTAL NO. OF DEVELOPMENTS (TIMES) |
|---|---|---|---|
| SVGA | 800×600 | 134 | 12 |
| XGA | 1024×768 | 171 | 15 |
| WXGA | 1386×788 | 231 | 20 |
| SXGA | 1280×1024 | 214 | 18 |
| SXGA+ | 1400×1050 | 234 | 20 |
| UXGA | 1600×1200 | 267 | 23 |
| Full HD | 1920×1080 | 320 | 27 |

FIG.8 b
b
a
a
a
b
: ALREADY WRITTEN PIXEL
: PIXEL TO BE NEWLY WRITTEN

APPARATUS AND METHOD FOR CONVERTING A DIGITAL VIDEO SIGNAL TO CONFORM WITH A DISPLAY PANEL FORMAT

TECHNICAL FIELD

The present invention relates to a display panel of the active matrix type, and more particularly to a drive apparatus, a drive method and a display panel drive system which can commonly comply with display panels of various display formats.

This Application claims priority of Japanese Patent Application No. 2003-307921, filed on Aug. 29, 2003, the entirety of which is incorporated by reference herein.

BACKGROUND ART

In display panels of the active matrix type, e.g., liquid crystal panels, etc., there is the trend where the number of pixels is increased with realization of high definition devices (display panels). In the case where the number of pixels is increased in such a way, since write time becomes short in dot sequential drive system where video signals are written by one pixel, there is employed a plural pixel simultaneous sampling system in which plural video signal input lines for delivering video signals from the external to the liquid crystal are provided to simultaneously perform sampling of video signals delivered from the plural video signal input lines to deliver the video signals thus sampled to plural pixels.

When the liquid crystal panel is caused to be driven by the plural pixel simultaneous sampling system, it is possible to obtain sufficient write time of video signal. Accordingly, in display panels of increased pixel number, i.e., relatively high definition active matrix type such as XGA (eXtended Graphic Array: 1024×768), WXGA (Wide eXtended Graphic Array: 1386×768), or SXGA (Super eXtended Graphic Array: 1400×1500), and display panels of increased pixel number, i.e., high definition active matrix type such as SXGA+(Super eXtended Graphic Array PLUS : 1400×1050), UXGA (Ultra eXtended Graphic Array: 1600×1200), Full HD (Full High Definition: 1920×1080), the plural pixel simultaneous sampling system is employed so that write operation of video signals can be satisfactorily executed.

The plural pixel simultaneous sampling system for driving the liquid crystal panel will be explained by using FIGS. 1 and 2.

FIG. 1 is a liquid crystal drive system 50 mounted in a liquid crystal projector, which comprises liquid crystal panels 60R, 60B, 60G which are respectively liquid crystal panel for red, liquid crystal panel for green and liquid crystal panel for blue driven by the plural pixel simultaneous sampling system.

The respective liquid crystal panels 60R, 60C, 60B that the liquid crystal panel drive system 50 has are a liquid crystal panel complying with the XGA format, wherein video signals are simultaneously written by 6 (six) pixels with respect to pixels in a horizontal direction by the plural pixel simultaneous sampling system.

The liquid crystal panel drive system 50 comprises a DSD (Digital Signal Driver) 51 including a DSD core 51*a* for implementing gamma correction and/or color unevenness correction, etc. to digital video signals for red (R), digital video signals for green (G) and digital video signal for blue (B) which are delivered from the external, and LCD drivers 52, 53, 54 for converging digital video signals which have been caused to undergo correction processing by the DSD 51 into analog video signals to deliver the analog video signals thus obtained to the respective liquid crystal panels 60R, 60B, 60G. The respective liquid crystal panels 60R, 60B, 60G are respectively mounted at liquid crystal panel modules 61R, 61G, 61B along with horizontal drive circuit and vertical drive circuits which are not shown.

The LCD drivers 51, 52, 53 serve to convert digital video signals delivered from the DSD 51 into analog video signals of which number corresponds to the number of sampling for performing simultaneous sampling of digital video signals delivered from the DSD 51. At the liquid crystal panels 60R, 60G, 60B which comply with the XGA format, since the number of simultaneous sampling operations is set to six (pixels), the LCD drivers 52, 53, 54 serve to convert digital video signals delivered into six parallel analog video signals.

It is to be noted that timing pulses for driving the respective liquid panels 60R, 60G, 60B are generated by a TG (Timing Generator) 51*b* of the DSD 51.

Subsequently, the plural pixel simultaneous sampling system will be explained in detail by using the liquid crystal panel module 61R shown in FIG. 2. It is to be noted that since plural pixel simultaneous sampling systems at liquid crystal panels 60R, 60G, 60B are entirely the same, explanation will be given by using, as representative, the liquid crystal panel module 61R on which liquid crystal panel 60R is mounted.

As shown in FIG. 2, the liquid crystal panel module 61R is supplied, through video signal supply lines VSIGI to VSIG6, six parallel analog signals which have been converted at the LCD driver 52.

The liquid crystal panel module 61R comprises groups of sampling switches $SW_N$ each comprised of six sampling switches for simultaneously performing sampling of six signal lines 63 among signal lines 63 that the liquid crystal panel 60R has.

The groups of sampling switches are driven in order of groups of sampling switches $SW_1$, $SW_2$, . . . , $SW_{N-1}$, and $SW_N$ in accordance with switch pulses delivered from a horizontal drive circuit 62. Thus, at the signal lines 63, video signals are simultaneously sampled in units of six video signals. As a result, video signals are written into pixels 64 in the row direction selected by vertical drive circuits (not shown).

Since it is necessary to sufficiently ensure write time of video signal in general, it is necessary that according as resolution of the liquid crystal panel becomes higher, it is required to increase the number of pixels to be simultaneously sampled by taking the transistor characteristic and/or the switch characteristic of the liquid crystal panel, etc. into consideration. For example, in the SXGA, it is necessary that the number of pixels subject to simultaneous sampling is set to 12 (pixels). In the UXGA, it is necessary that the number of pixels subject to simultaneous sampling is set to 24 (pixels).

As stated above, in the conventional plural pixel simultaneous sampling system, since it is necessary to change the number of pixels subject to simultaneous sampling in accordance with difference of the display format of the liquid crystal panel, it is required to also change the number of video signals delivered to the liquid crystal panel, i.e., the number of parallel analog video signals converted at the LCD drivers 52, 53, 54 in FIGS. 1 and 2 in accordance with the display format.

Accordingly, in order that the liquid crystal panel drive system 50 is caused to comply with liquid crystal panels of various display formats, LCD drivers 52, 53, 54 are required by the number of display formats. As a result, there would take place the problem that the cost is increased, and/or the apparatus becomes large-sized.

In addition, in the plural pixel simultaneous sampling system, there is the problem that there would take place ghost which is the phenomenon that the same image is displayed in the state shifted in a manner to overlap from image primarily displayed by the phase relationship between video signal and timing pulse.

DISCLOSURE OF THE INVENTION

Problems to be Solved by the Invention

An object of the present invention is to apply (provide) a novel drive apparatus and a novel drive method for display panel, and a novel display panel drive system which can eliminate or solve the problems that prior arts as described above have.

Another object of the present invention is to provide a drive apparatus, a drive method and a display drive panel system which are adapted for avoiding occurrence of ghost and for driving display panels of various display formats.

The drive apparatus according to the present invention is directed to a drive apparatus adapted for driving a display panel having x×y number of pixels arranged in a matrix form at intersecting portions of x number of signal lines disposed in a column direction and y number of gate lines disposed in a row direction, which comprises: data arrangement converting means for converting a digital video signal of m bits into data arrangement in conformity with display format of the display panel; first signal processing means for converting the digital video signal of the m bits which has been converted into the data arrangement in conformity with the display format by the data arrangement converting means into parallel analog video signals of p-phase; second signal processing means for developing the analog video signals of the p-phase which have been converted by the first signal processing means into analog video signals of x/k-phase to deliver the analog video signals thus developed to the x/k number of video signal supply lines which have been selected from N number of video signal supply lines; and signal line selecting means for sequentially selecting, one by one, at the same timing, desired signal lines from respective groups of the x/k number of signal lines obtained by dividing the x number of signal lines into the k number of signal lines adjacent in the state where they do not overlap with each other to perform sampling of the analog video signals delivered via the x/k number of video signal supply lines with respect to the selected signal lines.

Here, x, y, p, m, k are natural numbers, and N is natural number which satisfies $N \geqq (x/k)$.

The drive method according to the present invention is directed to a drive method of driving a display panel having x×y number of pixels arranged in a matrix form at intersecting portions of x number of signal lines disposed in a column direction and y number of gate lines disposed in a row direction, which comprises: converting a digital video signal of m bits into data arrangement in conformity with display format of the display panel; converting the digital video signal of the m bits which has been converted into the data arrangement in conformity with the display format into parallel analog video signals of p-phase; developing the analog video signals of the p-phase into analog video signals of x/k-phase to deliver the analog video signals thus developed to the x/k number of video signal supply lines which have been selected from N number of video signal supply lines; sequentially selecting, one by one, at the same timing, desired signal lines from respective groups of the x/k number of signal lines obtained by dividing the x number of signal lines into the k number of signal lines adjacent in the state where they do not overlap with each other; and performing sampling of the analog video signals delivered via the x/k number of video signal supply lines with respect to the selected signal lines.

Here, x, y, p, m, k are natural numbers, and N is natural number which satisfies $N \geqq (x/k)$.

The display panel drive system according to the present invention is directed to a display panel drive system of driving a display panel having x×y number of pixels arranged in a matrix form at intersecting portions of x number of signal lines disposed in a column direction and y number of gate lines disposed in a row direction, which comprises: a data arrangement converting unit for converting a digital video signal of m bits into data arrangement in conformity with display format of the display panel; a signal processing unit for converting the digital video signal of the m bits which has been converted into the data arrangement in conformity with the display format by the data arrangement converting unit into parallel analog video signals of p-phase; and a display panel module including the display panel having an arbitrary display format, signal processing means for developing the analog video signals of the p-phase which have been converted by the signal processing unit into analog video signals of x/k-phase to deliver the analog video signals thus developed to N number of video signal supply lines, a vertical drive circuit connected to the gate lines and serving to linearly sequentially drive the gate lines to select the x number of pixels in the row direction, signal line selecting means for sequentially selecting, one by one, at the same timing, desired signal lines from respective groups of the x/k number of signal lines obtained by dividing the x number of signal lines into the k number of signal lines adjacent in the state where they do not overlap with each other to perform sampling of the analog video signals delivered via the x/k number of video signal supply lines with respect to the selected signal lines, and video signal writing means for writing the analog video signals which have been caused to undergo sampling at the signal lines by the signal line selecting means into the pixels in the row direction which have been selected by the vertical drive circuit.

Here, x, y, p, m, k are natural numbers, and N is natural number which satisfies $N \geqq (x/k)$.

In the present invention, the number of pixels which can be written at a time is greatly increased to a degree of, e.g., 100 pixels or more, as compared to the plural pixel simultaneous sampling system of the conventional system. Accordingly, since sufficient write time can be ensured, it becomes possible to realize stable write operation.

Further, in the present invention, the display panel module is designed so as to comply with the highest definition display format, e.g., Full HD, thereby making it possible to flexibly cope with display panels of any display format only by adjustment of the number of developments of analog video signals, and/or simple adjustment to suitably change timing, etc. of sampling, etc. Particularly, in display formats SXGA+, UXGA, Full HD of high resolution, the system configuration can be greatly simplified.

Furthermore, in the present invention, desired signal lines are sequentially selected, one by one, at the same timing, from the respective groups of signal lines obtained by dividing signal lines of the display panel, thereby making it possible to completely remove occurrence cause of ghost taking place resulting from the fact that video signal is inserted (written) by deviation of phase relationship between video signal and timing pulse also except for video signals which are to be primarily written.

Still further objects of the present invention and practical merits obtained by the present invention will become more apparent from the description of the embodiments which will be given below with reference to the attached drawings.

BRIEF DESCRIPTION OF THE DRAWINGS

FIG. 6 is a view showing ratio between write time of video signal by the conventional system and write time which can be ensured in the above-mentioned display panel drive system.

FIG. 7 is a view showing the number of switches $SW_N$ necessary for respective display formats.

FIG. 8 is a view for explaining the number of developments of video signals by post-drive.

BEST MODE FOR CARRYING OUT THE INVENTION

The embodiments of a drive apparatus, a drive method and a display panel drive system according to the present invention will now be explained in detail with reference to the attached drawings.

Figure 1:
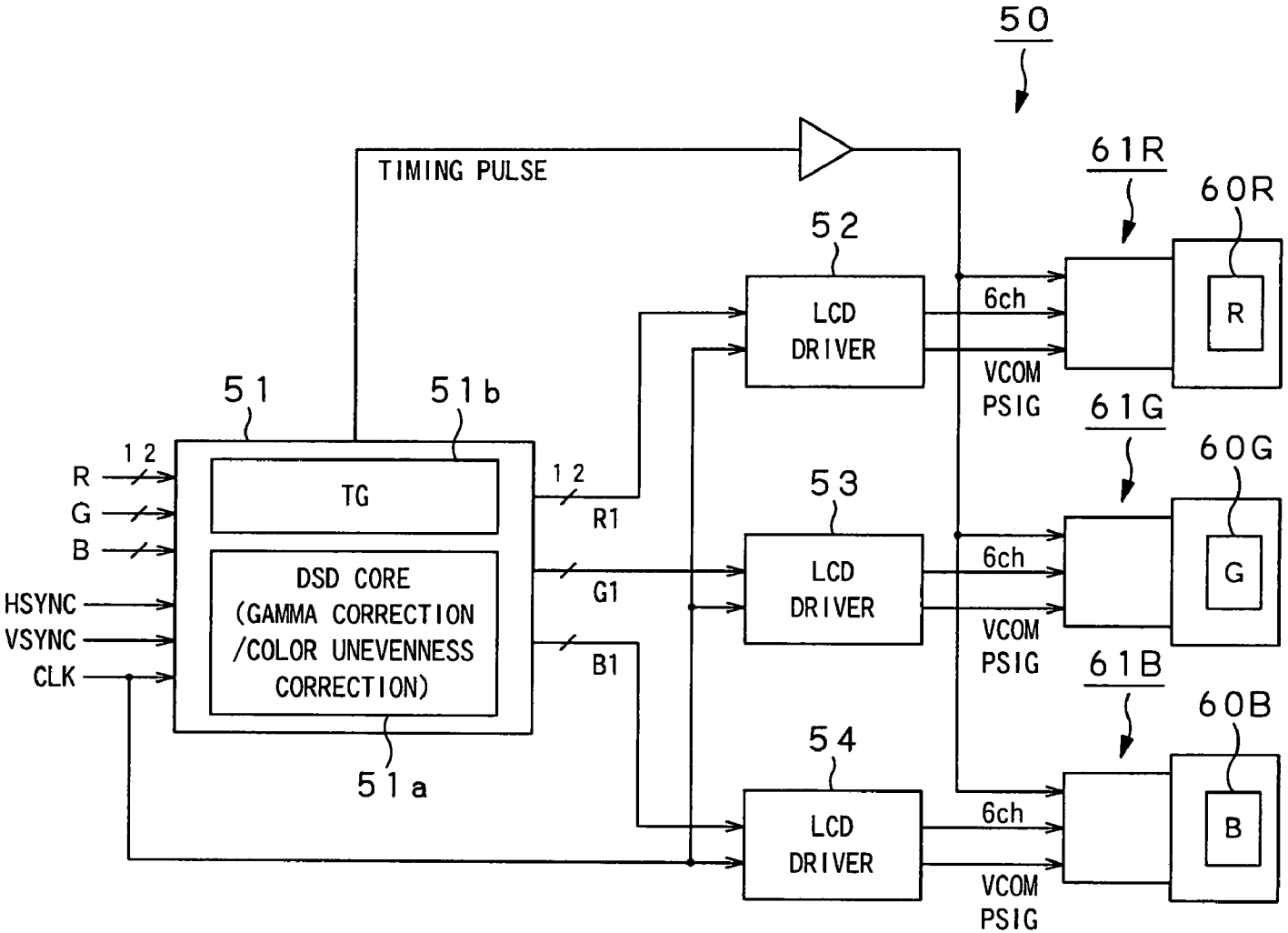
FIG. 1 is a block diagram of a conventional liquid crystal panel drive system to which plural pixel simultaneous sampling system is applied.
Figure 2:
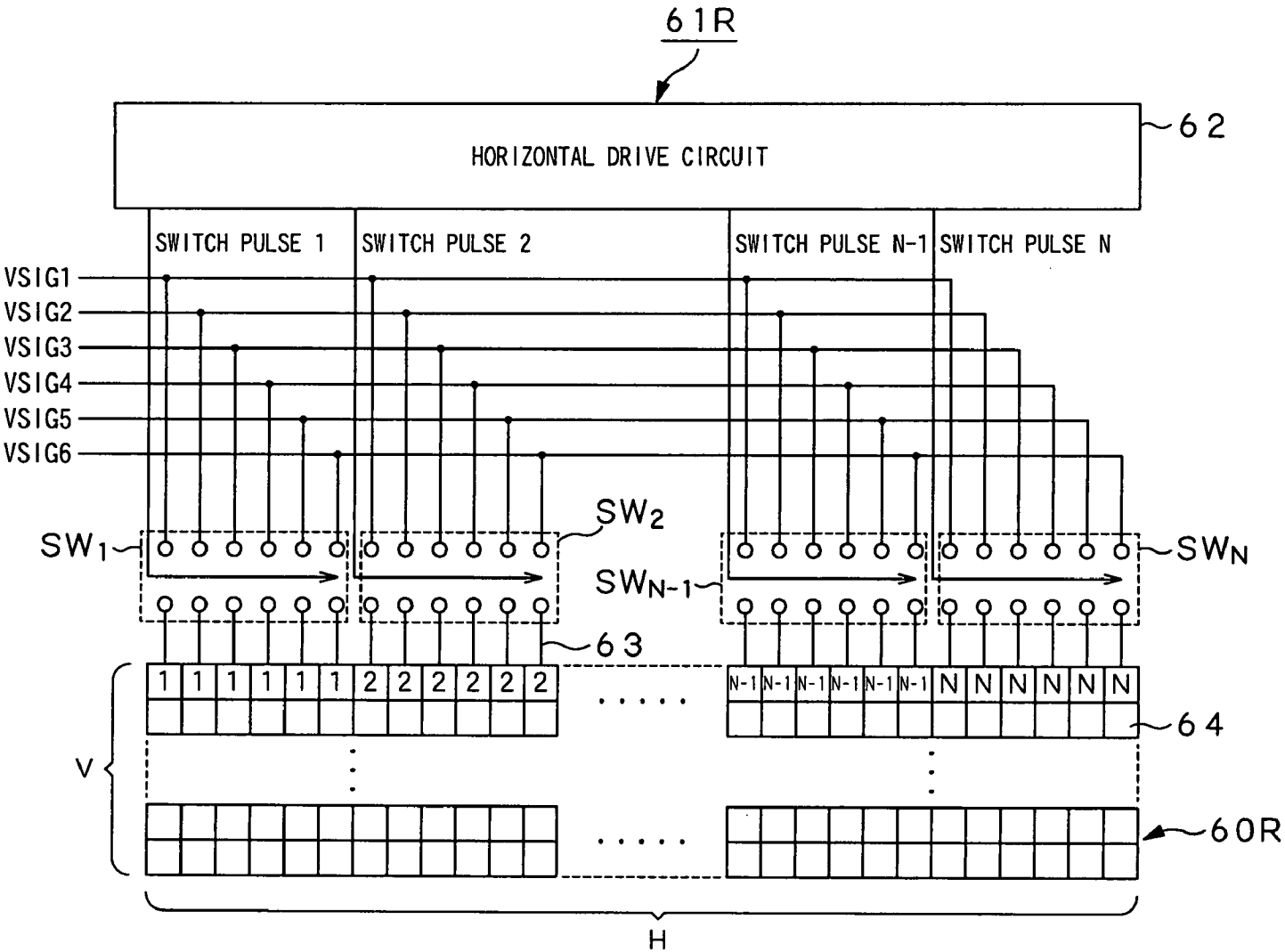
FIG. 2 is a circuit diagram showing a liquid crystal panel module used for explaining, in detail, plural pixel simultaneous sampling system.
Figure 3:
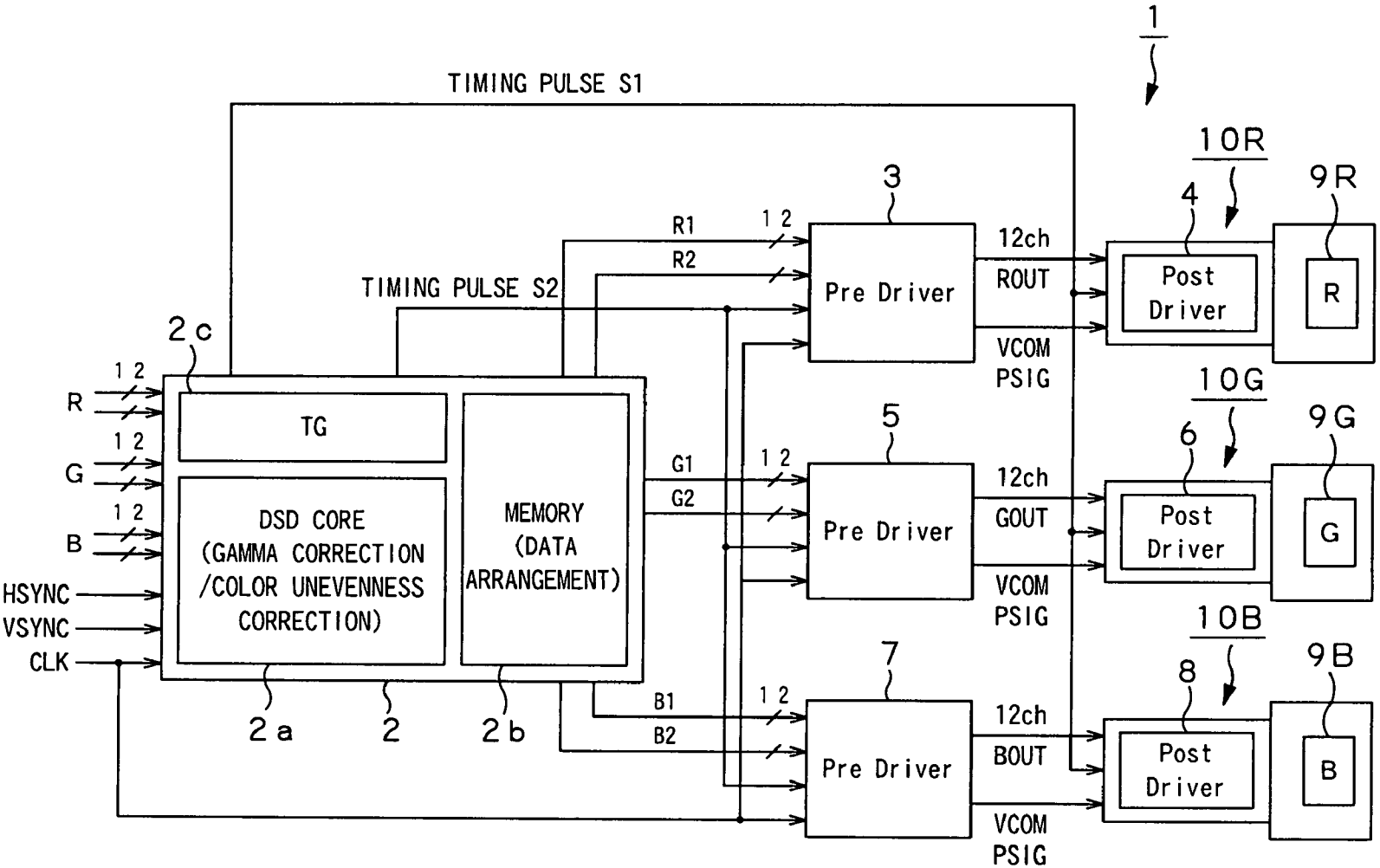
FIG. 3 is a block circuit diagram showing display panel drive system according to the present invention.

The liquid crystal panel drive system 1 according to the present invention will be explained by using FIG. 3.

The liquid crystal panel drive system 1 is provided at, e.g., liquid crystal projector of three plate (panel) type, etc., and comprises, as liquid crystal panel, a liquid crystal panel 9R for red, a liquid crystal panel 9G for green and a liquid crystal panel 9G for blue.

Moreover, the liquid crystal panel drive system 1 comprises a DSD (Digital Signal Driver) 2 for implementing a predetermined signal processing to a digital video signal delivered from the external, a Pre Driver 3 for driving the liquid crystal panel 9R, a Post Driver 4, a Pre Driver 5 for driving the liquid crystal panel 9G, a Post Driver 6, a Pre Driver 7 for driving the liquid crystal panel 9B, and a Post Driver 8.

The liquid crystal panel 9R and the Post Driver 4 are caused to be of the module configuration as a liquid crystal panel module 10R along with vertical drive circuit (not shown). Similarly, the liquid crystal panel 9G and the Post-Driver 6 are caused to be of module configuration as a liquid crystal panel module 10G along with vertical drive circuit (not shown). The liquid crystal panel 9B and the Post Driver 8 are caused to be of the module configuration as a liquid crystal panel module 10B along with vertical drive circuits (not shown).

The DSD 2 comprises a DSD core 2*a*, a memory 2*b*, and a TG (Timing Generator) 2*c*.

The DSD core 2a serves to implement digital signal processing such as gamma correction and/or color unevenness correction, etc. to respective digital video signals of RGB delivered from the external. Respective digital video signals of RGB are delivered from the external as parallel data of 12 bits. The numeric value of the 12 bits is based on the fact that video signal is handled by 12 bits in the liquid crystal panel drive system 50 shown as the prior art, and is a value only diverted (used) from a viewpoint of design. Accordingly, it is not necessarily required that this value is 12 bits, and takes m (m is natural number) bits.

In the memory 2*b*, there are stored respective digital video signals of RGB which have been caused to undergo digital signal processing at the DSD core 2*a*. The respective digital video signals of RGB stored in the memory 2*b* are converted into data arrangement corresponding to display format such as SVGA, XGA, WXGA, SXGA, SXGA+, UXGA, or Full HD, and are respectively delivered to Pre Drivers 3, 5, 7 in parallel as digital data of 12 bits. The Pre Driver 3 is supplied, in parallel, with digital video signals R1, R2 of 12 bits. The Pre Driver 5 is supplied, in parallel, with digital video signal of 12 bits as digital video signals G1, G2. The Pre Driver 7 is supplied, in parallel, with digital video signal of 12 bits as digital video signals B1, B2.

The timing generator 2*c* that the DSD 2 has generates timing pulse S2 delivered to the Pre Drivers 3, 5, 7, and timing pulse S1 delivered to the liquid crystal panel modules 10R, 10G, 10B. The Pre Drivers 3, 5, 7 and the liquid crystal panel modules 10R, 10G, 10B are controlled in synchronism with the timing pulse S1 or S2.

The Pre Drivers 3, 5, 7 respectively convert digital video signals inputted in parallel from the DSD 2 into analog video signal of p (p is natural number)-phase on the basis of the timing pulse S2 synchronous with video signal to respectively deliver those video signals to the Post Drivers 4, 6, 8. For example, the Pre Drivers 3, 5, 7 perform conversion into analog video signal of 12 phase on the premise that p is set to 12. It is to be noted that explanation will be given in the following description on the assumption that the Pre Drivers 3, 5, 7 convert digital video signal inputted from the DSD 2 into analog video signal of p=12 phase.

Moreover, the Pre Drivers 3, 5 7 also respectively generate pre-charge signal (PSIG) delivered to the liquid crystal panels 9R, 9G, 9B, and panel common DC voltage (VCOM).

Then, the liquid crystal panel modules 10R, 10G, 10B will be explained. Since the respective liquid crystal panel modules 10R, 10Q, 10B are all caused to be of the same configuration except for output wavelength regions of liquid crystal panels 9R, 9G,9B that the respective liquid crystal panel modules 10R, 10G, 10B have, the liquid crystal panel 10R will be explained as representative.

Figure 4:
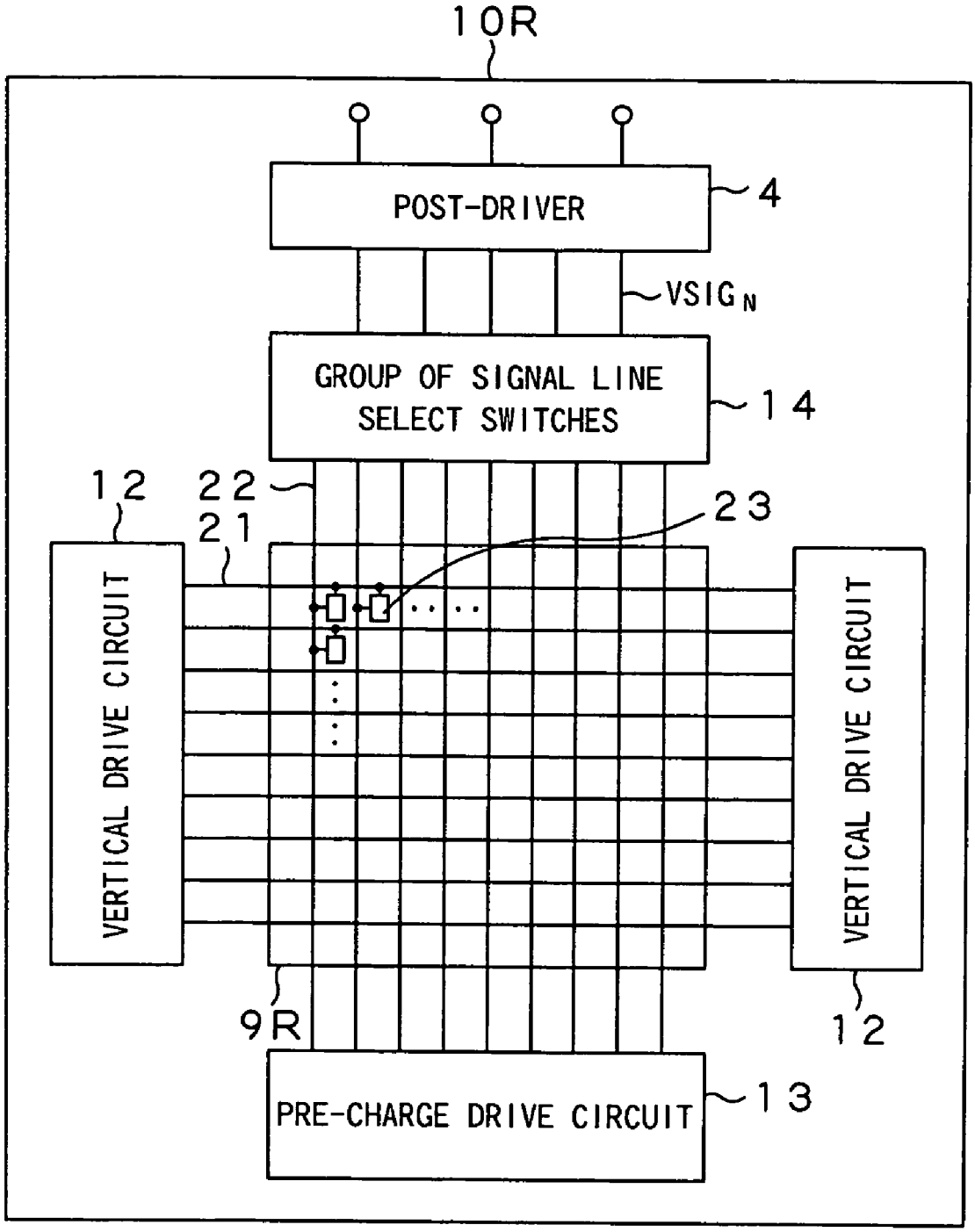
FIG. 4 is a block circuit diagram showing display panel module that the display panel drive system has.

As shown in FIG. 4, the liquid crystal panel module 10R comprises Post Driver 4, liquid crystal panel 9R, a vertical drive circuit 12, a pre-charge drive circuit, and a group of signal line select switches 14.

The Post Driver 4 respectively develops analog video signals of 12 phase delivered from the Pre Driver 3 into video signals corresponding to the number of outputs which comply with display formats such as SVGA, XGA, WXGA, SXGA, SXGA+, UXGA, and/or Full HD on the basis of timing pulse SI synchronous with video signal to deliver the video signals thus developed to the liquid crystal panel 9R through video signal supply line $VSIG_N$ (N is natural number) and the group of signal line select switches 14.

The development processing from the analog signals of 12 phase at the Post Driver 4 into video signals corresponding to the number of outputs which comply with the above-described display format is processing based on the sampling system executed in the liquid crystal panel drive system 1.

The sampling system of the liquid crystal panel drive system 1 is a system of first selecting signal line which will be described later that the liquid crystal panel 9R has by the number of outputs of video signals which have been developed at the Post Driver 4 to subsequently perform, plural times, an operation to write, at a time, at the same timing, video signals developed with respect to selected signal lines to perform sampling with respect to all signal lines. This sampling system is called signal line select sampling system.

The number of video signals developed by the Post Driver 4 on the basis of the signal line select sampling system is relatively determined by the display format of the liquid crystal panel 9R and the number of write operations for writing video signals onto all signal lines of the liquid crystal panel 9R.

For example, when the display format of the liquid crystal panel 9R is high definition display format having large number of pixels, it is necessary to increase the number of developments of video signals. Moreover, when the number of times required for writing video signals onto all signal lines of the liquid crystal panel 9R is decreased, it is required to increase signal lines onto which video signals are to be written at a time. Accordingly, it is necessary to also increase the number of developments of video signals. The signal line select sampling system will be explained in detail later.

The liquid crystal panel 9R comprises plural gate lines 21 wired in a row form, plural signal lines 22 wired in a column form, and pixels 23 disposed at portions where both lines intersect with each other.

The pixel 23 is composed of Thin Film Transistor (TFT) which is not shown, and liquid crystal cell which is not similarly shown. The gate electrode of the TFT is connected to corresponding gate line 21, the source electrode thereof is connected to corresponding signal line 22, and the drain electrode thereof is connected to one electrode (pixel electrode) of corresponding liquid crystal cell. The other electrode (opposite electrode) of the liquid crystal cell is supplied with panel common DC voltage (VCOM) generated at the Pre Driver 3 as a predetermined opposite potential.

The vertical drive circuit 12 is divided into left and right portions, which are connected to the gate lines 21, and serves to linearly sequentially drive the connected respective gate lines 21 from the both sides thus to select pixels 23 in a row direction.

The pre-charge drive circuit 13 applies, in advance, prior to write operation of video signal, pre-charge signal (PSIG) delivered from the Pre Driver 3 through pre-charge line (not shown) to respective signal lines 22 to perform pre-charge operation. This pre-charge operation is performed prior to write operation of video signals with respect to respective pixels 23.

A group of signal line select switches 14 is each comprised of plural switches for performing sampling of video signals delivered from the Post Driver 4 through video signal supply line $VSIG_N$ with respect to the signal line 22. The plural switches that the group of signal line select switches 14 are switched at the same timing on the basis of timing pulse S1 delivered from TG2c of the DSD2 to repeat such switching operations plural times to thereby perform sampling of video signals with respect to all signal lines 22 that the liquid crystal panel 9R has. The video signals which have been caused to undergo sampling with respect to the signal line 22 are written into pixels 23 in the row direction selected by the vertical drive circuit 12.

Subsequently, the configuration of the liquid crystal panel module required in carrying out the signal line select sampling system will be described in detail by using the liquid crystal panel module 10R with reference to FIG. 5.

Figure 5:
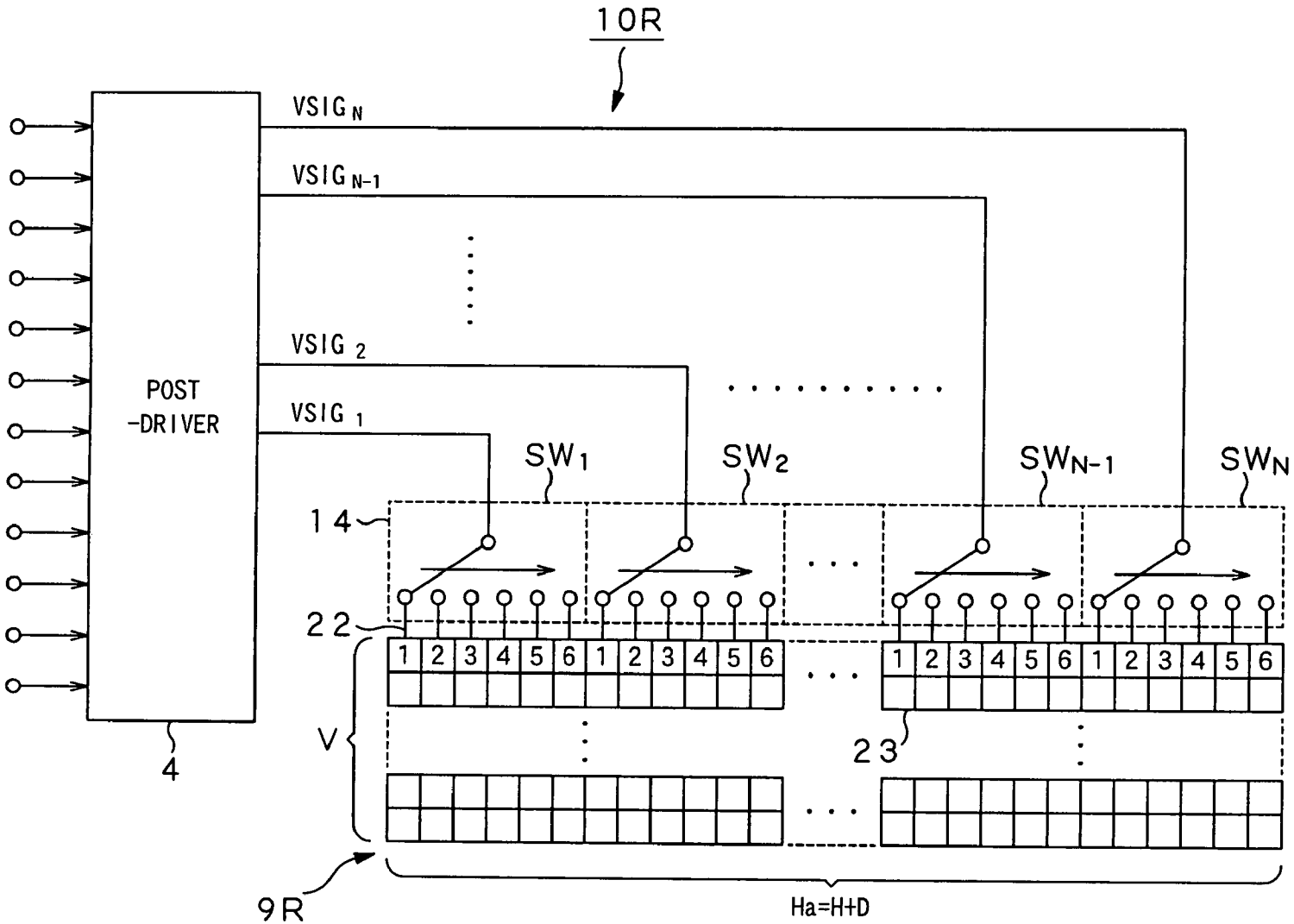
FIG. 5 is a block circuit diagram showing display panel module that the display panel drive system has.

As shown in FIG. 5, N (N is natural number) number of video signal supply lines $VSIG_1$ to $VSIG_N$ connected to the Post Driver 4 are respectively connected to the signal lines 22 through switches $SW_N$ that the group of signal line select switches 14 have. The switches $SW_N$ are provided, one by one, at six signal lines 22 adjacent in the state where they do not overlap with each other among the signal lines 22, and serve to select single signal line 22 every time timing pulse S1 is delivered from the group of signal lines with the six signal lines 22 being as unit.

For example, at the switch $SW_1$, signal line 22 located at the left end of the group of signal lines is selected at timing by the first timing pulse S1 and signal line adjacent at the right side is selected at the subsequent timing Thus, the remaining four signal lines 22 are selected in sequence. Similarly, at the switch $SW_N$ except for the switch SW , signal lines 22 are selected at the same timing as that of the switch $SW_1$, in order from the left end of the group of six signal lines.

As described above, respective switches $SW_N$ are simultaneously operated by timing pulse S1 to select respective one signal lines 22. Accordingly, the number of write operations with respect to all signal lines 22 that the liquid crystal panel 9R has becomes equal to the number of selections of the signal lines 22 by the switch $SW_N$, i.e., six times here.

The switches $SW_N$ may be provided in units of six signal lines as described above with respect to the signal lines 22 that the liquid crystal panel 9R has, and may be provided in units of arbitrary number of signal lines, e.g., in units of four signal lines or in units of eight signal lines. According as the number of signal lines 22 to be selected by the switch $SW_N$ is reduced and the number of switches $SW_N$ installed or provided is increased, the number of signal lines 22 which can be subject to sampling at a time becomes large. For this reason, it becomes possible to sufficiently ensure write time with respect to the signal line 22.

Ratios of write time A which can be ensured in the signal line select sampling system of the conventional system with respect to write time B by the plural pixel simultaneous sampling system (write time required in the case where six pixels are caused to undergo simultaneous sampling) are respectively shown in the case where the number of signal lines 22 to be selected is set to 1, 2, 4, 6, 8 are shown in FIG. 6.

As shown in FIG. 6, it can be understood that, in the signal line select sampling system, according as the number of signal lines to be selected by the switch $SW_N$ becomes smaller, longer write time can be ensured as compared to the conventional system.

If the liquid crystal panel 9R has the same display format, the number N of switches $SW_N$ constituting the group of signal line select switches 14 is determined by the number of signal lines 22 to be selected. For example, if the number of signal lines 22 to be selected becomes small, required number of switches $SW_N$ is increased. If the number of signal lines 22 to be selected becomes large, required number of switches $SW_N$ is decreased.

Moreover, if the number of signal lines 22 to be selected is the same, the number of switches $SW_N$ is determined by the display format of the liquid crystal panel 9R. For example, when the number of selected signal lines 22 is set to six, the number of pixels in the row direction becomes equal to 1386 at the liquid crystal panel 9R in which the display format is WXGA. From this fact, the number of signal lines 22 also becomes equal to 1386. Thus, from the relationship expressed as 1386/6=231, 231 switches $SW_N$ are required. Similarly, in the case where the number of signal lines 22 to be selected is set to six and the display format is caused to be Full HD, there results 1920/6=320. Thus, 320 switches $SW_N$ are required. The number of switches $SW_N$ necessary every display format in the case where the number of signal lines 22 to be selected is fixed to six is shown in FIG. 7. In FIG. 6, "A" indicates write time by the conventional system, and "B" indicates write time by the signal line selection system.

Meanwhile, as shown in FIG. 7, in the case where the display formats of the liquid crystal panel 9R are SVGA, XGA, SXGA, SXGA+, and UXGA, the respective numbers of signal lines 22 cannot be divided in the case where the number of signal lines 22 to be selected by the switch $SW_N$ is set to six.

Accordingly, when the number of signal lines is less than six, signal line 22 in which the number of switches $SW_N$ to be selected is less than six would take place. However, one switch $SW_N$ is assigned also with respect to the signal line 22. For example, since there results 800/6=133.33 . . . in the SVGA, the number of required switches $SW_N$ is set to 134 to cope with such situation.

At this time, dummy signal line and dummy pixel are added to the liquid crystal panel 9R in order to comply with one switch $SW_{134}$ which has been increased. In the SVGA, 133×6=798 signal lines 22 are caused to comply therewith up to the switches $SW_1$ to $SW_{133}$ Since six signal lines are supplemented by the switch $SW_{134}$, 804 signal lines 22 are necessary. In the display format of SVGA, since 800 signal lines 22 exist, four dummy signal lines are newly required. In view of the above, only four dummy pixel number (D) is also added by four in the row direction in correspondence with four dummy signal lines to be newly supplemented. The number of horizontal pixels shown in FIG. 7 is the number of horizontal pixels (Ha) in which dummy pixel number (D) is taken into consideration. In FIG. 7, "*" indicates that no dummy pixel is required.

Also in regard to other display formats XGA, SXGA, SXGA+and UXGA, dummy signal lines and dummy pixels are supplemented to the liquid crystal panel 9R in entirely the same manner to allow the number of horizontal pixels to be the number of horizontal pixels (Ha) as shown in FIG. 7, thereby making it possibly to take matching with the number of switches $SW_N$.

Subsequently, video signal delivered from the Post Driver 4 to the switch $SW_N$ through video signal supply lines $VSIG_1$ to $VSIG_N$ will be explained. The video signal delivered from the Post Driver 4 to the switch $SW_N$ through video signal supply lines $VSIG_1$ to $VSIG_N$ is a video signal developed from analog video signals of 12-phase at the Post Driver 4.

As described above, in the signal line select sampling system carried out in the liquid crystal panel drive system 1 according to the present invention, sampling of video signal is performed by switching operation by the switch $SW_N$ with respect to the signal line 22 of the liquid crystal panel 9R.

Accordingly, video signals delivered from the Post Driver 4 through video signal supply lines $VSIG_1$ to $VSIG_N$ are also required by the number of switches $SW_N$.

In view of the above, the Post Driver 4 develops video signals of 12-phase delivered from the Pre Driver 3 by the number of switches $SW_N$ determined by the display format of the liquid crystal panel 9R and the number of write operations with respect to the signal line 22 that the liquid crystal panel 9R has to output the video signals thus developed.

The number of outputs, i.e., the number of developments of video signals from the Post Driver 4 every display formats such as SVGA, XGA, WXGA, SXGA, SXGA+, UXGA, Full HD in the case where the number of signal lines 22 to be selected by the switch $SW_N$ is set to six is shown in FIG. 8. As stated above, the number of developments of video signals from the Post Driver 4 is determined by the display format of the liquid crystal panel 9R and the number of signal lines 22 to be selected by the switch $SW_N$.

From this fact, when the number of signal lines 22 of the liquid crystal panel 9R is set to x and the number of selected signal lines 22 per one switch $SW_N$ is set to k, switches $SW_N$ are required with respect to respective groups of x/k number of signal lines consisting of k number of signal lines adjacent in the state where they do not overlap with each other. For this reason, the number of developments by the Post Driver 4 also results in x/k phase.

Figures 9A, 9B, 9C, 9D, 9E, 9F, 9G:
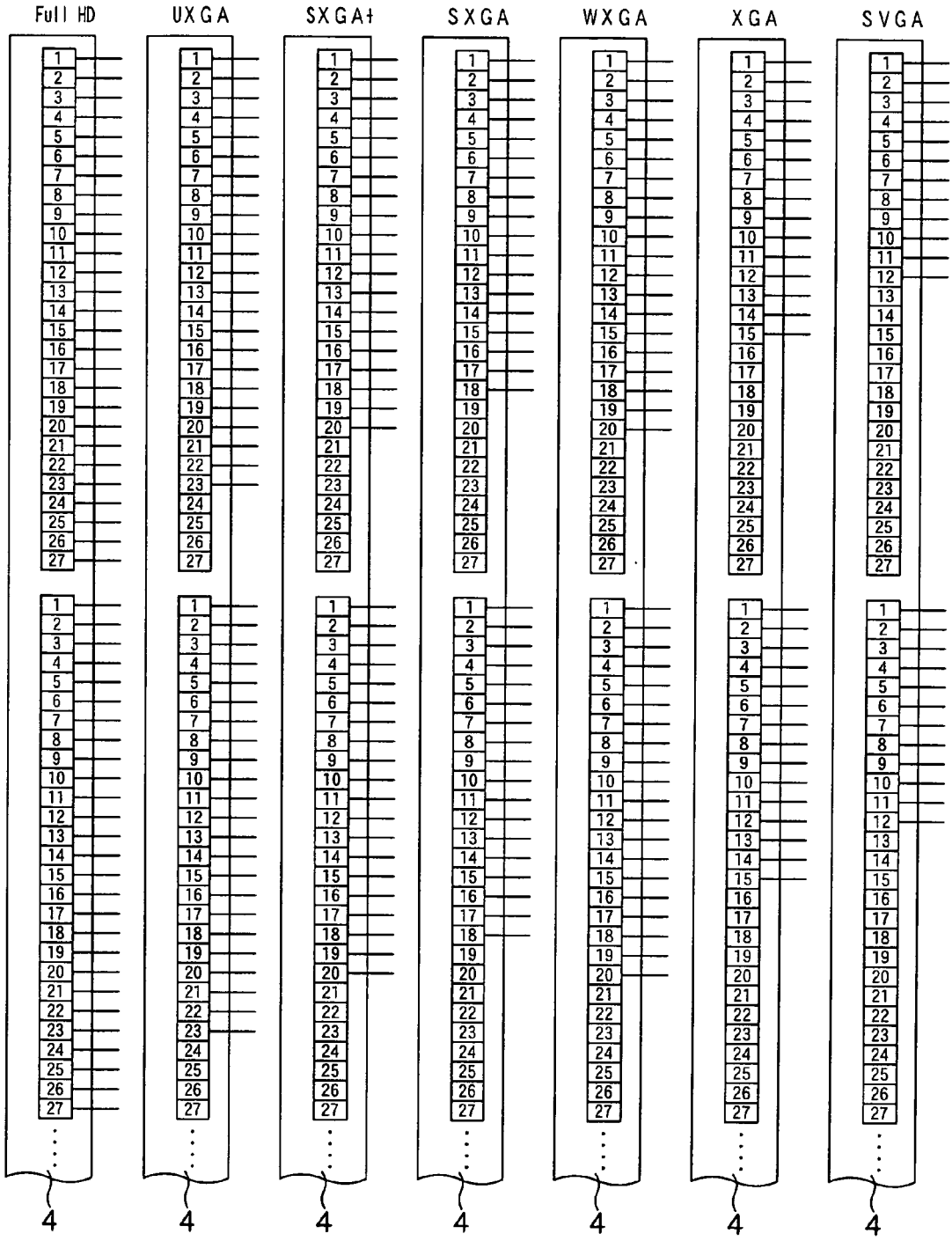
FIGS. 9A to 9G are views showing, every display format, the state where video signals are developed by the post-drive.

Moreover, the total number of developments shown in FIG. 8 indicates the number of developments per one phase of analog video signals of p-phase delivered from the Pre Driver 3 to the Post Driver 4. For example, when p is set to 12, the Post Driver 4 respectively develops analog video signals of 12-phase into analog video signals of 27-phase as shown in FIG. 9A in the Full HD.

At this time, the number of video signals developed into video signals of 27-phase becomes equal to 12×27=324 in total. Since the number of outputs by the Post Driver 4 becomes equal to 320 from the number of switches $SW_N$ necessary in the case where the display format is Full HD and the number of selected signal line 22 is six, four video signals are delivered to the dummy terminal, etc. so that they are not outputted. 320 video signals except for the above are delivered to 320 video signal supply lines $VSIG_1$, to $VSIG_{320}$ connected to the Post Driver 4.

Similarly, in the case where the display format of the liquid crystal panel 9R is UXGA, SXGA+, SXGA, WXGA, XGA, SVGA, the Post Driver 4 develops the video signals of 12-phase by the total number of developments shown in FIG. 8 to output the video signals thus developed to video signal supply lines $VSIG_1$ to $VSIG_N$ in a manner such that they are thinned as shown in FIGS. 9B, 9C, 9D, 9E, 9F, 9G Accordingly, in the liquid crystal drive system 1, the number of outputs pins of the Post Driver 4 of the liquid crystal panel module 9R, the number of video signal supply lines $VSIG_N$ physically wired and the number of switches SW<SUB>N</SUB> prepared at the group of signal line select switches 14 are designed so as to comply with the highest definition display format, e.g., Full HD to thereby adjust the number of developments of analog video signals of p-phase delivered from the Pre Driver 3 by the Post Driver 4 even in the case where liquid crystal panel of any display format is used thus to have ability to flexibly cope with such situation only by simple adjustment to suitably change timing pulse, etc. by the DSD2.

Further, the video signal which has been developed at the Post Driver 4 and has been delivered to video signal supply lines $VSIG_1$ to $VSIG_N$ is delivered to respective switches $SW_N$ that the group of signal line select switches 14 has. The video signal thus obtained is delivered to the signal line 22 that each switch $SW_N$ selects every time timing pulse S1 is delivered, and is written into pixels 23 on the gate line 21 selected by the vertical drive circuit 12.

Figures 10A, 10B, 10C, 10D, 10E, 10F:
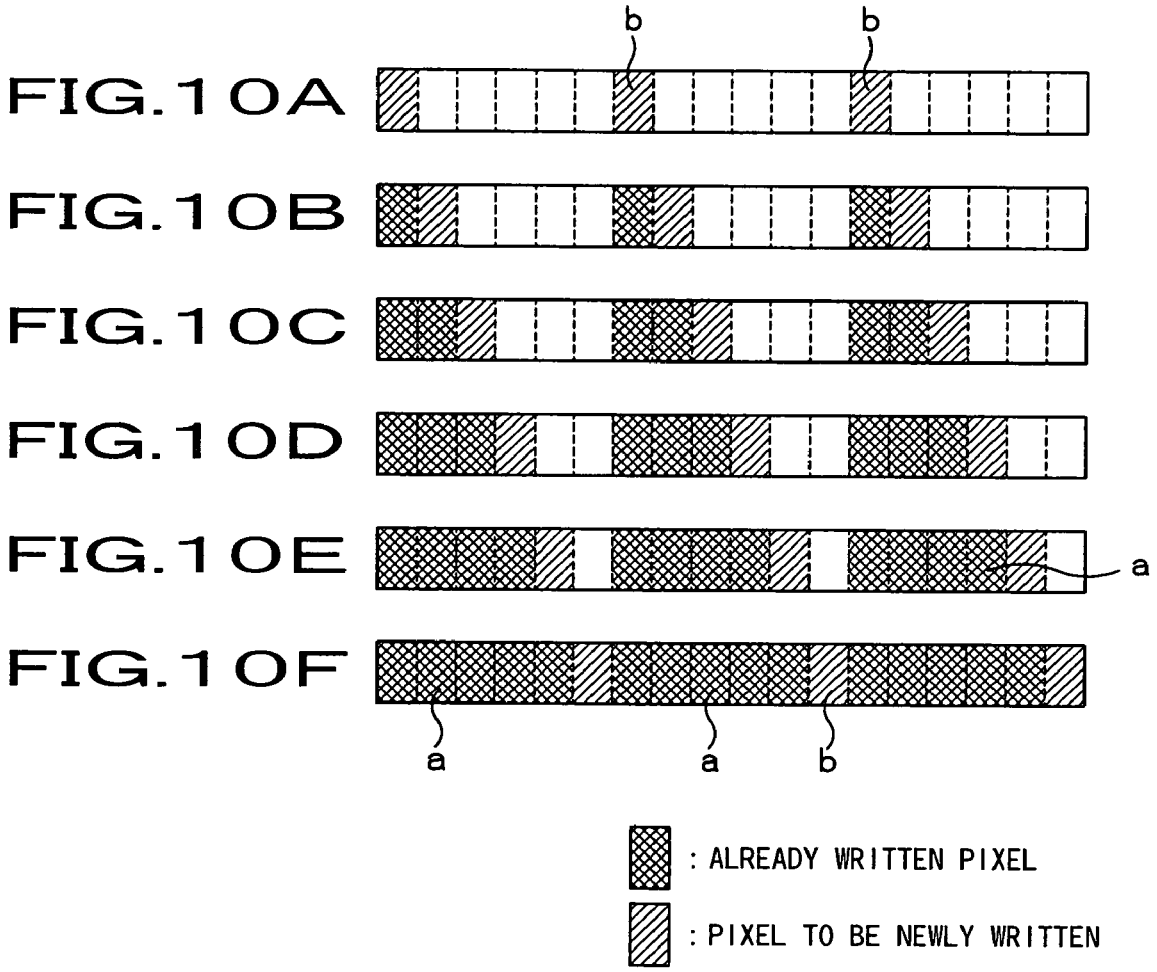
FIGS. 10A to 10F are views showing the state where video signals have been written into pixels by the signal line select sampling system.

For example, assuming that the number of signal lines 22 to be selected by the switch $SW_N$ is six, video signals are simultaneously written with respect to pixels arranged at interval of five pixels from pixel of the left end as shown in FIG. 10A at a first timing, and video signals are sequentially written into pixel adjacent at the right side as shown in FIGS. 10B, 10C, 10D, 10E, 10F at the subsequent timings.

In this case, the region of cross lines indicated at a in FIG. 10 indicates pixel which has been already written, and the region of slanting lines indicated at b indicates pixel which has been newly written.

Accordingly, in the signal line select sampling system, since pixels to be written at the same timing are not adjacent to each other so that they maintain a predetermined pixel spacing, there is no possibility that even in the case where the phase relationship between video signal and timing pulse deviates, this affects other pixels. Namely, it is possible to completely remove occurrence cause of ghost taking place resulting from the fact that, as in the case of the plural pixel simultaneous sampling system, in the case where phase relationship between video signal and timing pulse deviates, video signal is inserted (written) also except for video signals which are primarily to be written.

While explanation has been given in the above-described explanation by using the Pre Driver 3, the Post Driver 4 and the liquid crystal panel 9R, the signal line select sampling system is executed in entirely the same manner also in the case of the liquid crystal panel 9G driven by the Pre Driver 5 and the Post Driver 6 and/or the liquid crystal panel 9B driven by the Pre Driver 7 and the Post Driver 8.

As stated above, in the signal line select sampling system executed by the liquid crystal panel drive system 1, since the number of pixels which can be written at a time is greatly increased to a degree, e.g., from six to 100 pixels or more as compared to the plural simultaneous sampling system carried out as the prior art, it is possible to ensure write time which is larger than two times or more. For this reason, stable write operation is performed.

In addition, it is possible to comply with liquid crystal panels of various display formats by the same system configuration without performing change of IC, etc. Particularly, in SXGA+, UXGA, Full HD of high resolution, it becomes possible to greatly simplify the system configuration.

It is to be noted that whole the present invention has been described in accordance with preferred embodiments thereof in the accompanying drawings and described in detail, it should be understood by those ordinarily skilled in the art that the invention is not limited to embodiments, but various modifications, alternative constructions or equivalents can be implemented without departing from the scope and the spirit of the present invention as set forth by appended claims.

The invention claimed is:

1. A drive apparatus configured to drive a display panel, the drive apparatus comprising:

a digital signal driver configured to convert a digital video signal of m bits into a data arrangement, said data arrangement conforming with a display format of the display panel, said display panel having x×y number of pixels arranged in a matrix form at intersecting portions of x number of signal lines disposed in a column direction and y number of gate lines disposed in a row direction, said display format comprising a selectable one of a plurality of display formats, said plurality of display formats comprising: eXtended Graphic Array (XGA), Wide eXtended Graphic Array (WXGA), Super eXtended Graphic Arrayor (SXGA), SXGA+, Ultra eXtended Graphic Array (UXGA), and Full High Definition;

at least one pre driver configured to (a) receive the converted digital video signal and (b) convert said signal into parallel analog video signals of p-phase;

at least one module configured to develop the analog video signals of the p-phase into analog video signals of x/k-phase, said module configured to deliver the analog video signals of x/k phase to a selected x/k number of video signal supply lines selected from N number of video signal supply lines, wherein N≧x/k, and x/k is determined by the display format of the display panel; and a plurality of signal line selecting switches configured to sequentially select, one by one, at the same timing, desired signal lines from respective groups of the x/k number of signal lines obtained by dividing the x number of signal lines into the k number of the signal lines adjacent in the state where they do not overlap with each other to perform sampling of the analog video signals delivered via the x/k number of video signal supply lines with respect to the selected signal lines, wherein x, y, p, m, k, and N are natural numbers.

2. The drive apparatus as set forth in claim 1, wherein an input to the display panel comprises at least one dummy signal line, in addition to the selected number of video signal supply lines determined by the display format of the display panel and the display panel comprises at least one dummy pixel corresponding to the dummy signal line.

3. A drive method of driving a display panel, the drive method comprising:

converting a digital video signal of m bits into a data arrangement, said data arrangement conforming with a display format of the display panel, said display panel having x×y number of pixels arranged in a matrix form at intersecting portions of x number of signal lines disposed in a column direction and y number of gate lines disposed in a row direction, said display format comprising a selectable one of a plurality of display formats, said plurality of display formats comprising: one of eXtended Graphic Array (XGA), Wide eXtended Graphic Array (WXGA) Super eXtended Graphic Arrayor (SXGA), SXGA+, Ultra eXtended Graphic Array (UXGA), and Full High Definition;

receiving the converted digital video signal and converting said signal into parallel analog video signals of p-phase;

developing the analog video signals of the p-phase into analog video signals of x/k-phase to deliver the analog video signal to a selected x/k number of video signal supply lines selected from N number of video signal supply lines, wherein N≧x/k, and x/k is determined by the display format of the display panel;

sequentially selecting, one by one, at the same timing, desired signal lines from respective groups of the x/k number of signal lines obtained by dividing the x number of signal lines into the k number of signal lines adjacent in the state where that they do not overlap with each other; and performing sampling of the analog video signals delivered via the x/k number of video signal supply lines with respect to the selected signal lines, wherein x, y, p, m, k are natural numbers.

* * * * *